US005176305A

United States Patent [19]

Baarfüsser et al.

[11] Patent Number: 5,176,305

[45] Date of Patent: Jan. 5, 1993

[54] DEVICE FOR CONTROLLING WEB TRAVEL HAVING SUCTION MEANS FOR APPLYING PRESSURE ON THE TRAVELING WEB

[75] Inventors: Johann Baarfüsser, Gauting; Lothar Langer, Munich; Frank Mannaberg, Groebenzell; Reinhold Nentwich, Diessen, all of Fed. Rep. of Germany

[73] Assignee: BASF Magnetics GmbH, Mannheim, Fed. Rep. of Germany

[21] Appl. No.: 645,830

[22] Filed: Jan. 25, 1991

[30] Foreign Application Priority Data

Feb. 9, 1990 [DE] Fed. Rep. of Germany ..... 4003927

[51] Int. Cl.[5] ..... B65H 20/12

[52] U.S. Cl. ..... 226/95; 226/196; 277/DIG. 7

[58] Field of Search ..... 226/7, 93, 95, 97, 176, 226/200; 34/156, 160; 277/DIG. 7, 12

[56] References Cited

U.S. PATENT DOCUMENTS

| | | | |
|---|---|---|---|
| 3,299,676 | 1/1967 | Fujihashi | 277/DIG. 7 |
| 3,371,835 | 3/1968 | Pendleton | 226/95 X |
| 3,412,915 | 11/1968 | Hertrich | 226/95 X |
| 3,549,004 | 12/1970 | Zysman | 226/95 X |
| 3,942,787 | 3/1976 | Bolza-Schunemann | 271/237 |
| 4,202,542 | 5/1980 | Lammers et al. | 271/276 |
| 4,336,813 | 6/1982 | Seragnoli | 226/95 X |
| 4,381,212 | 4/1983 | Roberts | 226/95 X |
| 4,760,946 | 8/1988 | Bassa | 226/97 X |
| 4,862,799 | 9/1989 | Hyener et al. | 701/348 |

FOREIGN PATENT DOCUMENTS

| | | | |
|---|---|---|---|
| 0138117 | 7/1950 | Australia | 226/95 |
| 0017884 | 10/1980 | European Pat. Off. . | |
| 1962089 | 5/1971 | Fed. Rep. of Germany . | |
| 1574295 | 1/1976 | Fed. Rep. of Germany . | |
| 2501482 | 10/1980 | Fed. Rep. of Germany . | |
| 340408 | 9/1959 | Switzerland . | |
| 1441197 | 6/1976 | United Kingdom | 277/DIG. 7 |

*Primary Examiner*—Daniel P. Stodola
*Assistant Examiner*—P. Bowen
*Attorney, Agent, or Firm*—Connolly & Hutz

[57] ABSTRACT

A device for controlling webs of material, for example photographic films of webs of paper or magnetic tapes, in a so-called twin roller hollow suction means is described, wherein a pressure difference exists between the upper and lower side of the web in the region of the pair of rollers and wherein a respective sealing wedge is arranged according to the invention in the free interior (10) between the rollers (2, 3) on either side outwardly from the outer roller edges such that it passes beneath the edges (17) of the suspended web portion (5), the cross-sectional shape of the rollers is imitated and is at a small distance from the bearing faces of the rollers. In a particularly preferred embodiment, the sealing wedge is hollowed in the shape of a tank and extends transversely to the direction of travel falling away in the direction of the web center (FIG. 3).

1 Claim, 3 Drawing Sheets

DEVICE FOR CONTROLLING WEB TRAVEL HAVING SUCTION MEANS FOR APPLYING PRESSURE ON THE TRAVELING WEB

BACKGROUND OF THE INVENTION

The invention relates to a device for controlling moving webs of material in roller hollow suction means wherein the web rests on at least two rollers and wherein a pressure difference exists between the upper and lower side of the web in the region of the rollers.

PRIOR ART

Hollow suction means are preferably used in drying stations in which the layer or layers freshly applied to a substrate must not touch the surface of the guide rollers. The layers can be photographic or magnetic coatings which are applied to a paper or plastics substrate by means of a coating device known from the state of the art. A beaded corrugated web form is produced as the web of material passes over the hollow suction means. In the limit case of a hollow suction means with only two rollers, the web has only one bead. The radius of curvature of the bead in the web or the loop of web depends upon the pressure difference of the web tension. The beaded form of web guarantees an angle of wrap which is sufficiently great for good web travel, independently of the guidance of the web through the drying station. A wide variety of designs of hollow suction means adapted to the respective web guidance can therefore be used.

A known requirement during the construction of such roller stations is that a minimum angle of wrap of the web has to be observed for each roller. Relative speeds between web and roller surface are thus avoided, and this is important for materials having sensitive surfaces (films or magnetic tape).

Plane hollow suction means are known in which the roller axes lie in a plane and convey the web in a vertically ascending or descending manner or in a horizontally carrying or suspended manner. If the roller axes are located on a cylinder face, they are arc-type hollow suction means for deflection of the web through, for example, 90° or 180°, without the coated web face coming into contact with the rollers. The hollow suction means is also suitable for three-dimensional web guide means in which the roller axes are not parallel. A drying station with meandering web guide means is described in DE-AS 19 62 089, in which the plane roller hollow suction means are used for upward and downward guidance and arc-type hollow suction means are used for web deflection at the upper ends of the vertical loops.

DE-PS 15 74 295 describes an application of the roller hollow suction means for three-dimensional web guidance using mutually staggered rolls, while DE-PS 25 01 482 describes parallel moving rolls arranged so as to pivot in the web plane toward stationary rolls.

The twin roller hollow suction means described in DE-PS 15 97 656 has gained technical importance for long drying stations which are guided straight in a horizontal direction. In these drying stations, the web is guided so as to rest on hollow suction means on the first path and to hang on hollow suction means on the return path.

An air turbine drive for rollers of hollow suction devices is known from EP 0 017 884, which receives its energy from the pressure difference between the upper and lower side of the web of material.

The construction of the roller hollow suction means is identical in all types. The hollow suction means consist of at least two freely rotatably mounted rollers having, on the rear, a housing which is subjected to reduced pressure and substantially seals the rollers from normal atmospheric pressure. The web is guided via the front side of the rollers and is pressed by the normal atmospheric pressure against the rollers behind which a reduced pressure prevails. Increased web pressure against the rollers and a greater wrap of the rollers are thus achieved owing to the suction on the web.

OBJECT OF THE INVENTION

The object of the invention was to provide a device of the type mentioned at the outset which dispenses with drivable rollers of hollow suction means, in which the web tension is kept as low as possible while the lateral stability of the web of material is simultaneously increased and in which the web is guided as accurately as possible without the risk of damage such as scratching or folding. A further object was to install a minimum number of devices in a drying station of restricted length, even with a high web speed. The final object was to allow access to the rollers in the device for cleaning purposes.

According to the invention, the objects were achieved with a device for controlling moving webs of material characterized in that sealing wedges (6, 12) are arranged on either side in a free space (10) between rollers (2, 3) such that they penetrate from external roller edges to the centre of the web and are arranged beneath the suspended portion of web (5) such that they pass beneath the edges of the web (17) and wherein the faces of the sealing wedge turned toward the bearing faces of the rollers are at a slight distance therefrom. Further details of the invention follow from the subclaims, the drawings and the description.

SHORT DESCRIPTION OF THE DRAWINGS

The invention will now be described in more detail with reference to the drawings.

FIGS. 1*a* and 1*b* show an embodiment according to the invention in a cross section (a) and in a longitudinal section (b).

FIGS. 2*a* and 2*b* show a particularly preferred device according to the invention in a cross section (a) and in a longitudinal section (b).

PREFERRED EMBODIMENTS OF THE INVENTION

Figure 1B:
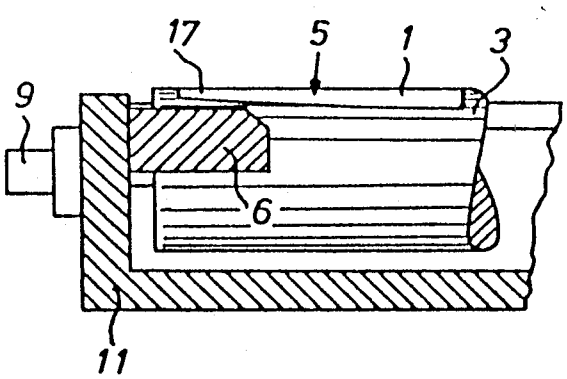
Figure 1A:
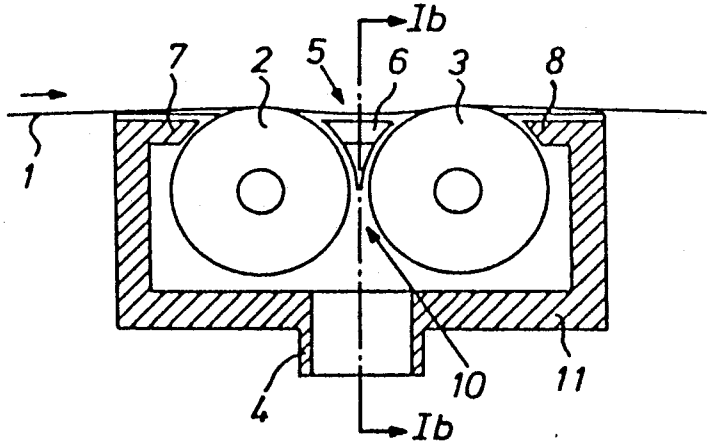

As shown in FIG. 1*a*, a coated web of material 1 runs in the direction of the arrow with the coated side at the top and the carrier side at the bottom via the pair of rollers 2, 3 which, together with the suction box 11 and the suction nozzle 4, represent a twin roller hollow suction means known from the state of the art. The rollers 2, 3 are mounted by bearing journals 9 in the lateral pieces of the suction box 11. The web wraps the two rollers in the region 5 under the influence of the suction.

It is essential to the invention to arrange a sealing wedge 6 on either side on the lateral faces of the suction box 11 adjacent to the upper side of the rollers in the free space 10 between the pair of rollers 2, 3, the free end of the sealing wedge 6 penetrating so far toward the centre of the web that it passes at least beneath the edges 17 of the web of material 1 in its curved portion. The faces of the sealing wedge 6 turned toward the rollers 2, 3 follow the cylindrical external face of the rollers and are at a very short distance from them so as to aspirate as little additional air as possible. The face of the sealing wedge 6 turned toward the underside of the web of material extends substantially parallel to the web, as shown in FIG. 1*b*, but can also extend with an inward taper. The pressure difference between the upper and lower side of the curved web 5 is adjusted such that the web just hovers above the sealing wedge. The faces of the suction box 11 turned toward the rollers are also designed as sealing wedges 7, 8 and are at a small distance from the rollers.

Figure 2B:
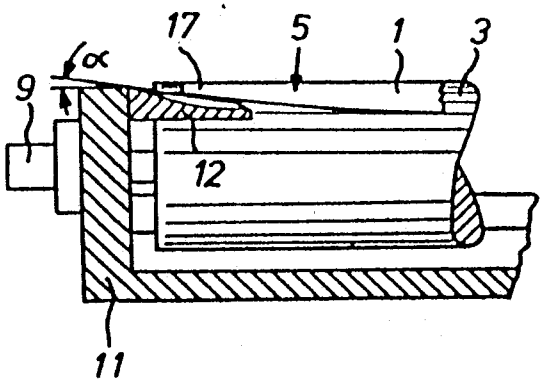
Figure 2A:
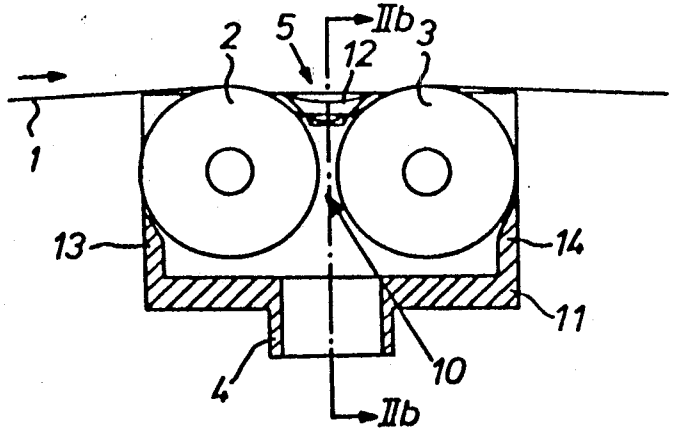
Figure 3:
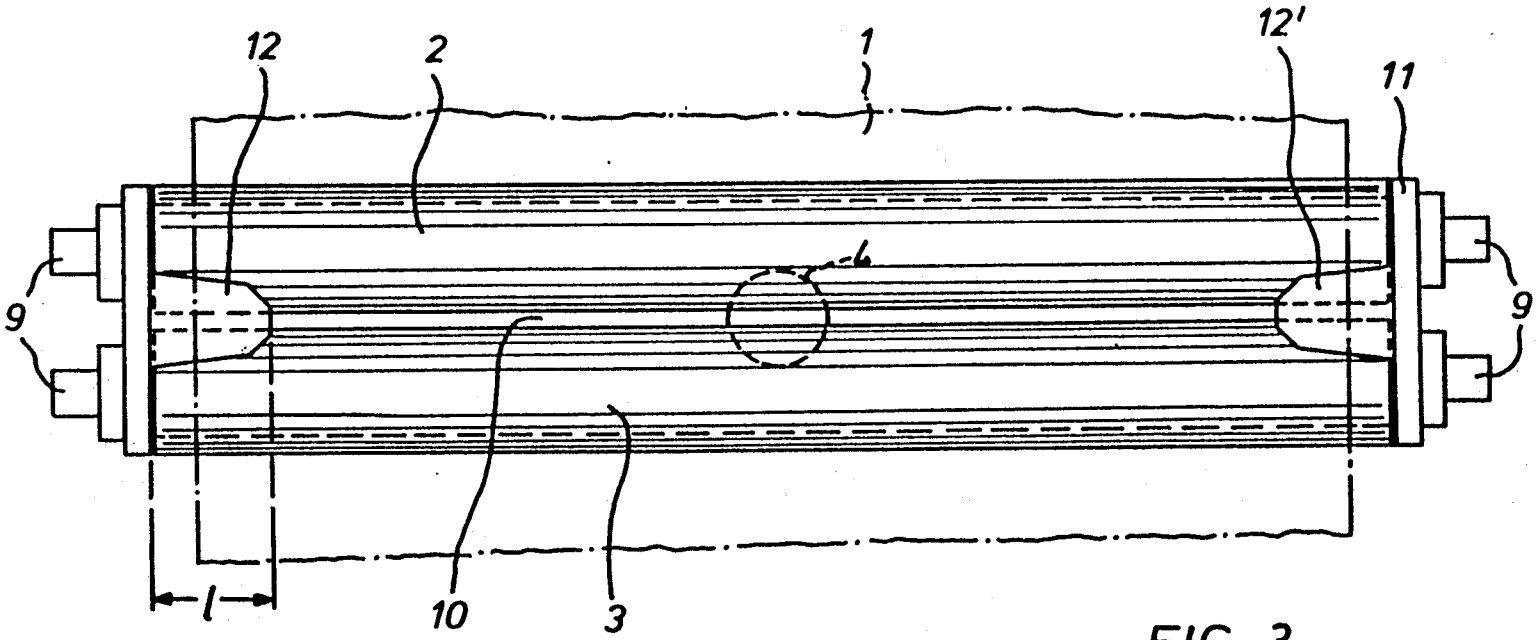
FIG. 3 shows a plan view of a device according to FIG. 2.

FIGS. 2*a* and 2*b* as well as FIG. 3 show a particularly preferred embodiment of the invention. In this arrangement, the sealing wedge 12 has a tank-shaped configuration on its side facing the web and its underside does not penetrate so far between the rollers into the interior 10. The lateral sealing wedges 13, 14 of the suction box 11 are arranged beneath the axis of rotation of the rollers, again substantially improving access to the rollers for cleaning purposes. The tank-shaped design of the sealing wedge, which falls away obliquely toward the centre of the web in the form of a run-on wedge, as shown in FIG. 2*b*, has the advantage that the web is invariably spaced above the sealing wedge and hovers even when the web extends laterally, i.e. perpendicularly to the direction of travel. The taper angle $\alpha$ of the wedge is a few degrees, preferably 3°.

Figure 4:
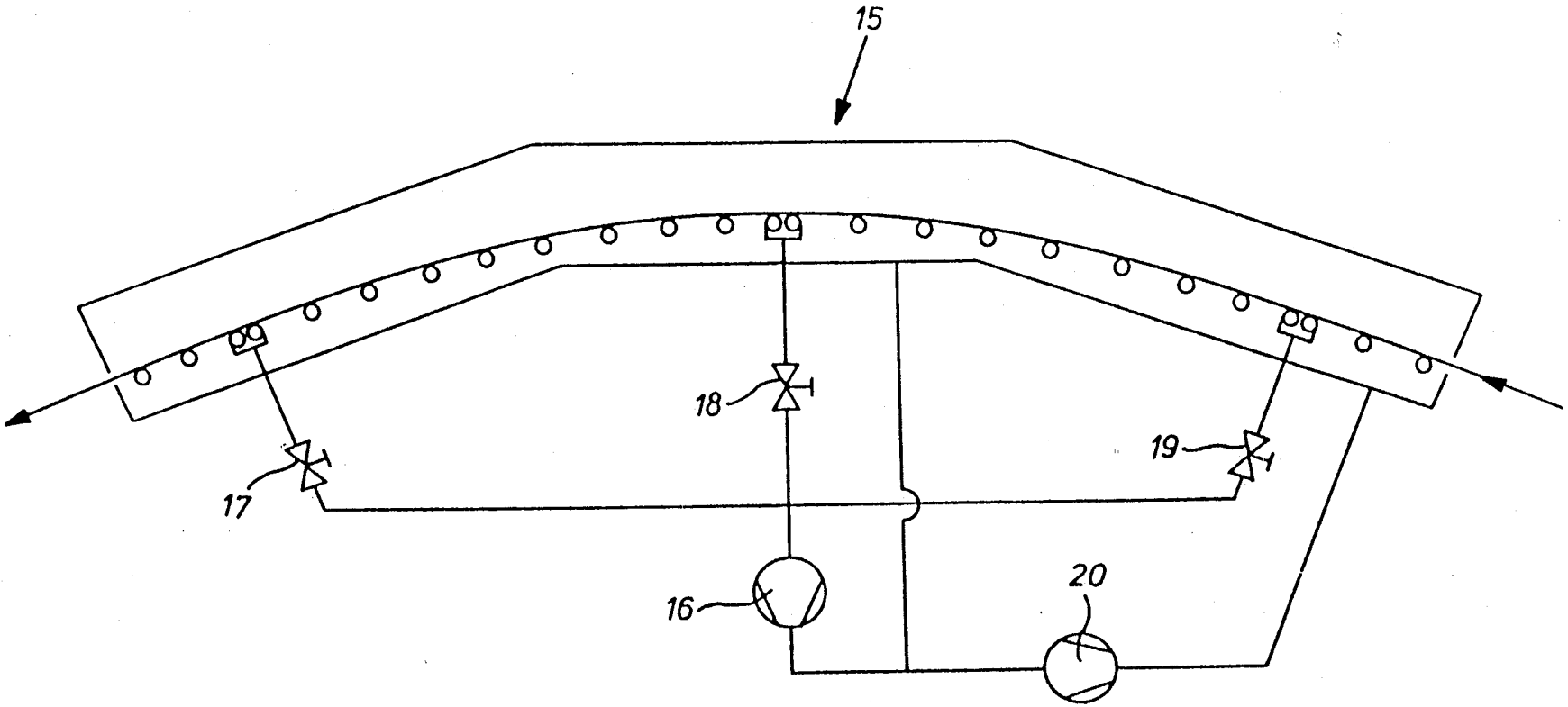
FIG. 4 shows a schematic arrangement of the hollow suction devices according to the invention in a drying station.

FIG. 3 shows a plan of the device according to the invention shown in FIGS. 2*a* and/or 2*b* and, in particular, the two-sided symmetrical arrangement of the sealing wedges 12, 12' and the manner in which they taper inwardly in the form of a wedge. In a preferred embodiment, the device according to the invention, as shown in FIG. 4, is arranged three times in a drying station 15, namely in the vicinity of the entrance, the centre and the outlet. An extraction fan 16, for example a radial fan, is connected via intermediate valves 17, 18, 19 to the three hollow suction devices, so that the process gas can be recycled into the drying station 15 via a fan 20.

EXAMPLE

A 67 cm wide plastics web coated with a magnetic layer ran with its rear side at a speed of 300 m/minute through an approximately 20 m long drying station operated at a drying temperature of 140° C., over several aluminium rollers having a diameter of 80 mm and a width of 75 cm. The three pairs of rollers of the hollow suction devices were radially spaced by 10 mm. A sealing wedge composed of anodised aluminium penetrated into the interior on either side, as shown in FIGS. 2*a*, 2*b* and 3, with a radial clearance of about 0.5 mm from the bearing face of the rollers and with length of 75 mm. The lateral sealing wedges 13, 14 of the suction box 11 were spaced less than 0.5 mm from the roller faces in each case. The taper angle $\alpha$ of the sealing wedge was 3°. The web of material could be controlled in a stable manner with a pressure difference of 4 to 10 mbar between upper and lower side of the web of material and with a web tension of 8 to 14 kp, without damage being observed.

What is claimed is:

1. In a web transporting apparatus the combination of at least two adjacently positioned hollow-suction rollers capable of rotation on parallel axes in the same direction, said rollers being spaced apart so as to provide spacing between respective peripheries extending the length of the juxtaposed peripheries, wedge-shaped members extending, in the spacing, axially of the rollers only partially of the length of the spacing and having faces toward the roller peripheries positioned a slight distance from surfaces of the rollers, a region of the spacing defined by the wedge-shaped members and the adjacent peripheries forming a passageway between the rollers, a web resting on at least two rollers transportable through said apparatus, edges of the web overlying the wedge-shaped members, and a chamber for applying suction to the rollers and the spacing to provide a pressure difference between the surface of the web contacting the rollers and the opposite surface of the web, and the wedge shaped members are hollowed in the form of a tank on their upper side in the direction of travel of the web (1) and at the same time fall away transversely to the direction of travel at an angle ($\alpha$), which is preferably about 3°, in the form of a wedge in the direction of the web centre, characterized in that the wedge shaped members are arranged to penetrate the spacing between the rollers beneath the edges of the web which is suspended over the spacing.

* * * * *